US009581969B2

(12) United States Patent
Stranczl et al.

(10) Patent No.: US 9,581,969 B2
(45) Date of Patent: Feb. 28, 2017

(54) COMBINED RESONATOR WITH IMPROVED ISOCHRONISM

(71) Applicant: THE SWATCH GROUP RESEARCH AND DEVELOPMENT LTD, Marin (CH)

(72) Inventors: Marc Stranczl, Nyon (CH); Jean-Jacques Born, Morges (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/027,478

(22) PCT Filed: Jul. 7, 2015

(86) PCT No.: PCT/EP2015/065434

§ 371 (c)(1),
(2) Date: Apr. 6, 2016

(87) PCT Pub. No.: WO2016/037726

PCT Pub. Date: Mar. 17, 2016

(65) Prior Publication Data

US 2016/0246258 A1 Aug. 25, 2016

(30) Foreign Application Priority Data

Sep. 9, 2014 (CH) ..... 1360/14
Sep. 9, 2014 (CH) ..... 1361/14
Sep. 12, 2014 (EP) ..... 14184631

(51) Int. Cl.
*G04B 17/04* (2006.01)
*G04B 15/02* (2006.01)
(Continued)

(52) U.S. Cl.
CPC ..... *G04B 17/26* (2013.01); *G04B 15/02* (2013.01); *G04B 17/04* (2013.01); *G04B 17/045* (2013.01);
(Continued)

(58) Field of Classification Search
CPC ..... G04B 15/00; G04B 15/02; G04B 15/06; G04B 17/04; G04B 17/045; G04B 17/10
See application file for complete search history.

(56) References Cited

U.S. PATENT DOCUMENTS 3,585,424 A * 6/1971 Neel ..... G04B 17/045 310/15
3,683,213 A * 8/1972 Staudte ..... G04B 17/045 219/121.69
(Continued)

FOREIGN PATENT DOCUMENTS

CH 703 475 A2 1/2012
EP 2 570 870 A1 3/2013

OTHER PUBLICATIONS

International Search Report issued Oct. 6, 2015 in PCT/EP2015/065434 filed Jul. 7, 2015.

*Primary Examiner* — Vit W Miska
(74) *Attorney, Agent, or Firm* — Oblon, McClelland, Maier & Neustadt, L.L.P.

(57) ABSTRACT

A timepiece assembly including a combined resonator with at least two degrees of freedom which includes a first linear or rotary oscillator with reduced amplitude in a first direction relative to which oscillates a second linear or rotary oscillator with reduced amplitude in a second direction substantially orthogonal to the first direction. The rotary oscillator includes a second weight carrying a sliding-block. A wheel set is arranged for application of a torque to the resonator, the wheel set including a groove in which the sliding-block slides with minimal play. The sliding-block is
(Continued)

arranged at least either to follow curvature of the groove when present, or to rub with friction in the groove, or to repel the inner lateral surfaces of the groove by magnetically or electrically charged surfaces in the sliding-block.

15 Claims, 3 Drawing Sheets

(51) Int. Cl.

| | |
|---|---|
| ***G04B 17/10*** | (2006.01) |
| ***G04B 17/26*** | (2006.01) |
| ***G04B 17/06*** | (2006.01) |
| ***G04C 3/10*** | (2006.01) |
| ***G04C 5/00*** | (2006.01) |

(52) U.S. Cl.
CPC ..... *G04B 17/063* (2013.01); *G04B 17/10* (2013.01); *G04C 3/10* (2013.01); *G04C 5/005* (2013.01)

(56) References Cited

U.S. PATENT DOCUMENTS

| | | | | |
|---|---|---|---|---|
| 5,268,881 | A * | 12/1993 | Damm ..... | G04B 18/003 368/134 |
| 2013/0070572 | A1 | 3/2013 | Helfer et al. | |
| 2013/0170330 | A1 | 7/2013 | Hessler et al. | |

* cited by examiner

COMBINED RESONATOR WITH IMPROVED ISOCHRONISM

CROSS-REFERENCE TO RELATED APPLICATIONS

This is a National phase Application in the United States of International patent Application PCT/EP2015/065434 filed Jul. 7, 2015 which claims priority on European patent Application 14184631.1 filed Sep. 12, 2014, and Swiss patent Application 01360/14 filed Sep. 9, 2014 and Swiss patent Application 01361/14 filed Sep. 9, 2014. The entire disclosure of the above patent applications are hereby incorporated herein by reference.

FIELD OF THE INVENTION

The invention concerns a timepiece assembly comprising a combined resonator with at least two degrees of freedom, which includes a first linear or rotary oscillator with reduced amplitude, oscillating substantially in a first direction, relative to which oscillates a second linear or rotary oscillator with reduced amplitude, oscillating substantially in a second direction substantially orthogonal to said first direction, said second oscillator including a second weight carrying a sliding-block, said timepiece assembly comprising a wheel set arranged for application of a torque to said resonator, said wheel set comprising a groove in which said sliding-block slides with minimal play.

The invention also concerns a timepiece movement comprising one such timepiece assembly.

The invention also concerns a watch equipped with such a movement.

The invention concerns the field of timepiece mechanisms, and more specifically mechanical resonators.

BACKGROUND OF THE INVENTION

There is a known combined resonator comprising two resonators with flexible bearings placed in series with each other, and wherein a weight of one resonator carries a pin that cooperates with a groove of a wheel set subjected to a torque.

However, there remains in this pin-groove connection friction which is not constant or controlled.

SUMMARY OF THE INVENTION

The invention proposes to improve the isochronism of such a combined resonator, particularly by controlling the friction between, on the one hand, the sliding-block or the pin, and on the other hand, the groove.

To this end, the invention concerns a timepiece assembly comprising a combined resonator with at least two degrees of freedom, which includes a first linear or rotary oscillator with reduced amplitude, oscillating substantially in a first direction, relative to which oscillates a second linear or rotary oscillator with reduced amplitude, oscillating substantially in a second direction substantially orthogonal to said first direction, said second oscillator including a second weight carrying a sliding-block, said timepiece assembly comprising a wheel set arranged for application of a torque to said resonator, said wheel set comprising a groove in which said sliding-block slides with minimal play, according to claim 1.

The invention also concerns a timepiece movement comprising one such timepiece assembly.

The invention also concerns a watch equipped with such a movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
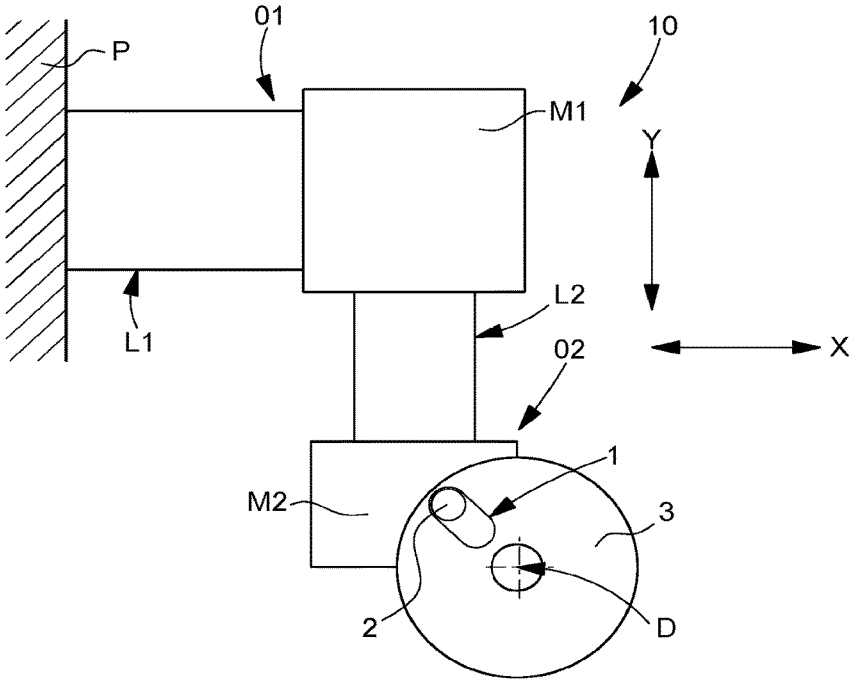
FIG. 1 shows a schematic plan view of a combined resonator comprising two resonators with flexible bearings placed in series with each other, and wherein a weight of one resonator carries a pin which cooperates with a groove of a wheel set subjected to a torque, such as an escape wheel.

As seen in FIG. 1, there is a known combined resonator with at least two degrees of freedom derived from placing in series two resonators with flexible bearings each comprising a weight M1, M2, the weight M1 of the first resonator O1 being suspended by first flexible strips L1 from a fixed structure P such as a plate. This first oscillator O1 oscillates essentially in a first linear direction Y. The first movable weight M1 of first resonator O1 acts as an anchor for the second flexible strips L2 of a second resonator O2, which essentially oscillates in a second linear direction X, substantially perpendicular to first linear direction Y. The second movable weight M2 of second resonator O2 includes a sliding-block (formed by a simple pin 2 in the specific case of FIG. 1), which cooperates with a groove 1 carried by a wheel set 3 subjected to a torque, typically an escape wheel.

The invention is applicable to rotary oscillators with low amplitude, notably an angular amplitude of less than 12°, or to linear oscillators. It is more particularly described in the variant with linear oscillators.

The return forces are not exactly proportional to motions, since the flexible guide members L1, L2 used in such combined resonators are very short, which results in non-linearity of the force of the spring as a function of motion, which introduces an isochronism defect.

Further, if the two resonators O1 and O2 are not properly synchronised, this causes an elliptical motion of the sliding-block, driven by groove 1 which rotates with wheel set 3.

There is a risk of the elliptical motion taking an eccentricity of zero, and being transformed into a simple linear back-and-forth motion, which would greatly disrupt the system.

The nature of the guiding between the sliding-block and groove 1 thus directly affects the isochronism of such a combined resonator used for a timepiece application.

The invention therefore proposes to control this relative, direct or indirect guiding between the sliding-block (or pin 2) and groove 1, by acting on the shape of groove 1 or and/or on the nature of the guiding.

To this end, the invention concerns a timepiece assembly 10 comprising one such combined resonator with at least two degrees of freedom, which includes a first linear or rotary oscillator O1 with reduced amplitude oscillating substantially in a first direction Y with respect to which oscillates a second linear or rotary oscillator O2 with reduced amplitude oscillating substantially in a second direction X substantially orthogonal to first direction Y. Second oscillator O2 comprises a second weight M2 carrying a sliding-block. Timepiece assembly 10 comprises a wheel set 3 arranged for application of a torque to the resonator, wheel set 3 comprising a groove 1 in which the sliding-block slides with minimal play.

According to the invention, this sliding-block is arranged to at least, either follow the curve of groove 1 where present, or to rub with friction in groove 1, or to repel the lateral inner surfaces 11, 12 comprised in groove 1, by means of magnetically or electrically charged surfaces comprised in the sliding-block.

The sliding-block represents the most general case, and may be a mechanical sub-assembly with several components, wherein some components may have degrees of freedom, particularly pivoting, in relation to each other. The case where the sliding-block is reduced to a pin is a specific case.

Figure 2:
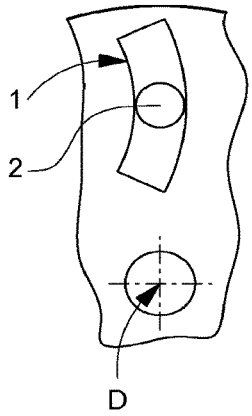
FIG. 2 shows a schematic plan view of a particular arrangement of this pin and of the groove of the wheel set, in a first embodiment of the invention, wherein the groove comprises at least one curve.
Figure 3:
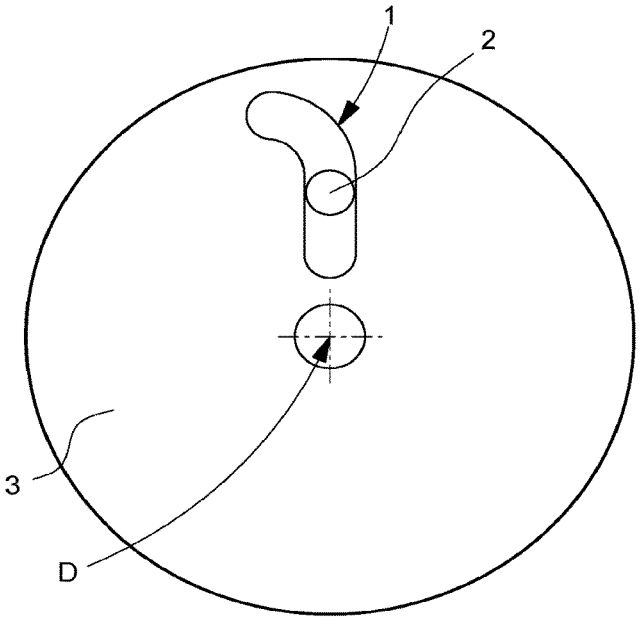
FIG. 3 shows a schematic plan view of another variant of this first embodiment wherein the groove comprises a radial portion tangentially connected to a portion comprising at least one curve.

In a first embodiment of the invention, as seen in FIGS. 2 and 3, in order to make the system isochronous, groove 1 which acts as a guide for the sliding-block, reduced here to a pin 2, carried by the second weight M2 of second oscillator O2, is arranged in a particular manner.

According to the first embodiment of the invention, this groove 1 is given a shape creating a radial force, which corrects the spring constant variation of the flexible guide strips. This force may be directed towards the centre or outwards, depending on the shape of the groove.

To achieve this, groove 1 comprises at least one curved portion.

In a particular manner, groove 1 is substantially radial with respect to the pivot axis D of wheel set 3.

In a particular manner, groove 1 comprises at least one concave area relative to a radial line derived from pivot axis D of wheel set 3.

A first embodiment is an entirely curved groove, as seen in FIG. 2.

In an advantageous variant, the concavity of this groove 1 decreases gradually from the axis of rotation of the wheel set bearing the groove.

A second embodiment, as seen in FIG. 3, is a groove 1 comprising a first inner radial portion with respect to axis of rotation D of wheel set 3 bearing this groove 1, which is tangent to a second curved portion whose concavity is constant or decreases away from axis of rotation D so as to compensate for isochronism defects.

In another, non-illustrated variant, groove 1 is straight but not radial.

In particular, and as illustrated by the Figures in the various embodiments, the inner lateral surfaces 11 and 12 are parallel to each other.

Figure 4:
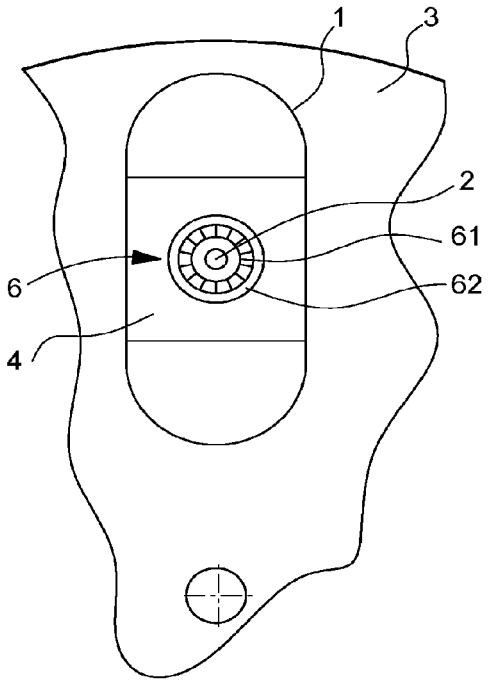
FIG. 4 shows a schematic plan view of a particular arrangement of such a combined resonator, wherein a sliding-block slides in the groove of the wheel set, in a second embodiment of the invention, shown in a non-limiting variant wherein the groove is straight and radial, and wherein the sliding-block comprises a pin that pivots in a friction pad in the groove, and shown in a non-limiting variant wherein the pad carries a ball bearing in which a pin pivots.

In a second embodiment seen in FIG. 4, to make the system isochronous, groove 1 is equipped with a sliding-block comprising a friction pad 4 which slides with friction in groove 1. In the non-limiting example of FIG. 4, this friction pad is prismatic with a complementary profile to that of groove 1, and slides in the groove.

The function of the friction between friction pad 4 and groove 1 is to attenuate the elliptical motion of the sliding-block towards a circular motion.

When friction pad 4 bears a pin 2, carried by second weight M2, two types of friction can be created between pin 2 and groove 1:

- the first between pin 2 and friction pad 4, this first friction being advantageously minimised and especially made constant, by a ball bearing 6, pin 2 then carrying the inner cage 61 of ball bearing 6, and the outer cage 62 of ball bearing 6 being mounted in friction pad 4;
- the second is the friction between friction pad 4 and groove 1.

This friction pad 4 can enable a 90° phase shift between the two oscillators O1 and O2, and thus prevent the trajectory collapsing into a line.

Figure 5:
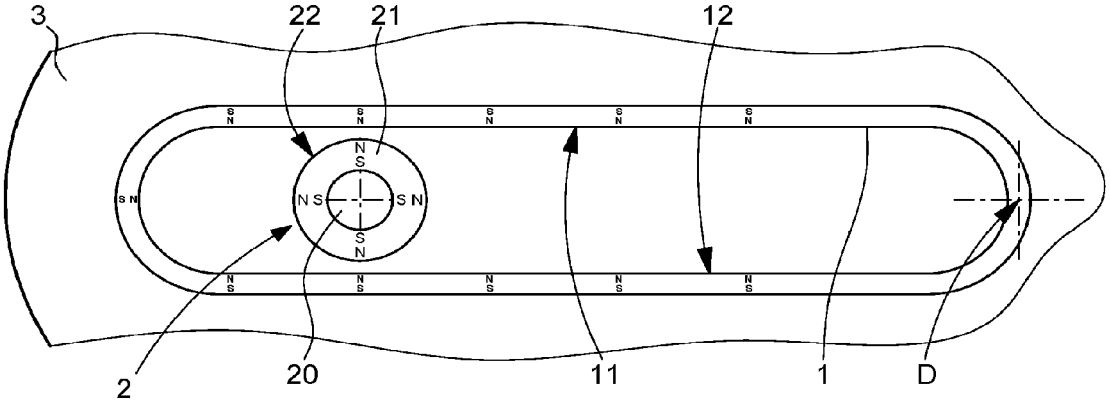
FIG. 5 shows a schematic plan view of a particular arrangement of such a combined resonator, wherein a sliding-block slides in a groove of the wheel set, in a third embodiment of the invention, shown in a non-limiting variant wherein the groove is straight and radial, and wherein a repulsive sliding-block slides in the groove against the field in a particular variant wherein the repulsive sliding-block is in the form of a ring which is slidably movable in the groove, remote from lateral surfaces of the groove, under the effect of magnetic and/or electrostatic repulsion fields, this ring may form a pin or receive a cylindrical pin or similar element.

In a third embodiment of the invention, as seen in FIG. 5, it is possible to improve the efficiency of this design by removing the friction between the sliding-block and groove 1, by using surfaces that repel each other, particularly comprising magnets and/or electrets. Such an arrangement is proposed in FIG. 5, in the particular non-limiting case of magnetic repulsion.

The inner lateral surfaces 11, 12 of groove 1 are magnetically or electrically charged and are arranged to repel magnetically or electrically charged surfaces of the sliding-block. The sliding-block is then a repulsive sliding-block, in a particular and non-limiting manner in the form of a radially magnetised ring 21, or, in a specific variant illustrated in FIG. 5, includes a shaft portion 20 which carries such a magnetic ring 21. More specifically, ring 21 is arranged to be mounted on a shaft portion 20 of a pin 2 carried by the second weight M2, or to form such a pin 2.

In the magnetic alternative illustrated in FIG. 5, groove 1 is also magnetically charged in order to always repulsed by the repulsive sliding-block.

In the same manner as the sliding-block, groove 1 may be, either magnetically charged throughout its entire structure, or comprise a sufficient number of individual magnets whose magnetisation is oriented in a direction perpendicular to the local tangent to the inner surface of groove 1.

Groove 1 and the repulsive sliding-block thus together form a friction-free crank rod system, whose main advantages are increased efficiency and reduced wear. The self-start oscillation of the combined resonator is also improved.

In an electrostatic variant, the magnets can be replaced by electrets.

In either the magnetic or electrostatic variant, the magnetically, respectively electrically charged area of groove 1 and/or of the repulsive sliding-block, in particular in the form of a ring 21, may result from a surface layer treatment of the respectively ferromagnetic or electrostatically conductive material, forming groove 1 and/or the repulsive sliding-block.

The repulsive sliding-block is preferably mounted to be slidably movable with minimal play in groove 1 of wheel set 3, remote from inner lateral surfaces 11, 12 of groove 1, under the effect of magnetic and/or electrostatic repulsion fields. The periphery 22 of the repulsive sliding-block is thus always remote from these lateral surfaces 11, 12, which, in a preferred application, are parallel.

Figure 6:
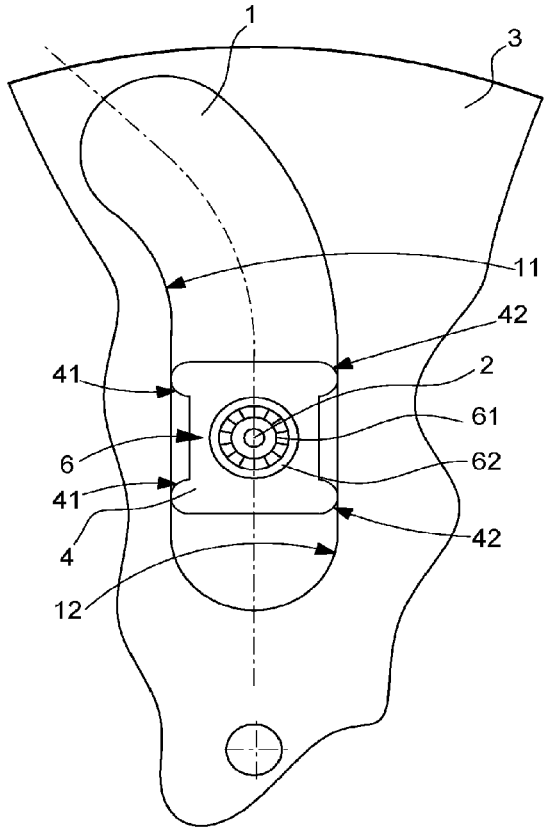
FIG. 6 shows a schematic plan view of a fourth embodiment combining the first and second embodiments, and wherein a sliding-block with a friction pad slides in a groove comprising at least one curve.

In a fourth embodiment, as seen in FIG. 6, the first and second embodiments are combined, with a groove 1 comprising at least one curve, in which a friction pad 4 slides.

In a first variant of this fourth embodiment, friction pad 4 has surfaces of contact with inner lateral surfaces 11, 12 of groove 1, which are very reduced, particularly each in the form of one or more semi-cylindrical bosses 41, 42 or suchlike. At least a first boss 41 cooperates with a first inner surface 11 of groove 1 and at least a second boss 42 cooperates with a second inner surface 12 of groove 1. Preferably, at least two first bosses 41 cooperate with a first inner surface 11 of groove 1 and at least one second boss 42 cooperates with a second inner surface 12 of groove 1, or vice versa. The illustrated variant comprises two first bosses 41 remote from one another cooperating with first inner surface 11, and two second bosses 42 remote from one other other cooperating with second inner surface 12.

In another variant of this fourth embodiment, the friction pad comprises at least one resilient and/or hinged portion allowing it to follow the local curve of groove 1 as it slides, while maintaining substantially constant friction.

Figure 7:
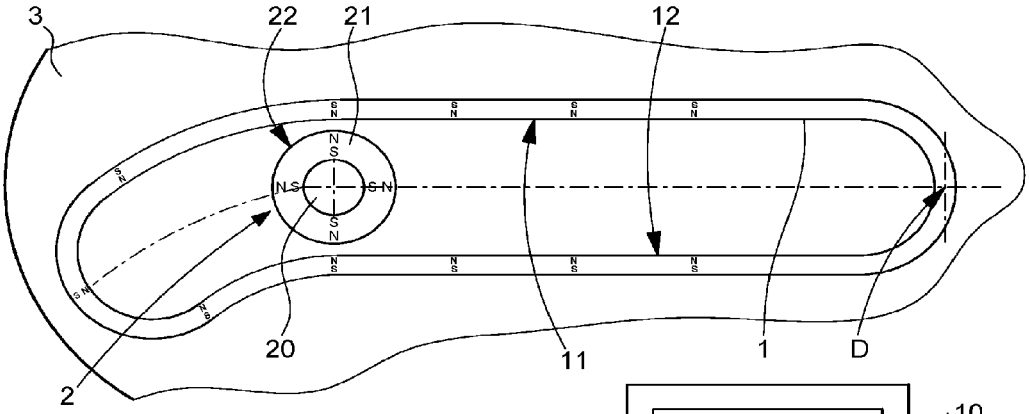
FIG. 7 shows a schematic plan view of a fourth embodiment combining the first and third embodiments, and wherein a repulsive sliding-block slides in a groove comprising at least one curve.
Figure 8:
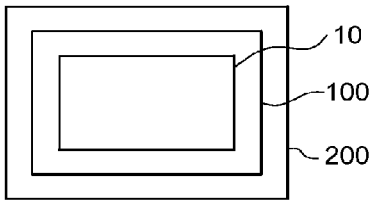
FIG. 8 is a block diagram showing a watch including such a movement equipped with such a combined resonator.

In a fifth embodiment, as seen in FIG. 7, the first and third embodiments are combined, with a groove 1 comprising at least one curve, in which a repulsive sliding-block slides.

The invention further concerns one such combined resonator 10 equipped with one such wheel set 3 with a groove 1, which is straight or comprises at least one curved portion, and/or comprising inner magnetically or electrically charged surfaces, this groove 1 slidably receiving a sliding-block arranged to follow the curvature of the groove where present, and/or the sliding-block is either a sliding-block rubbing with friction in groove 1, or is a magnetically or electrically charged repulsive sliding-block.

The invention also concerns a timepiece movement 100 including one such timepiece assembly 10.

The invention also concerns a watch 200 including one such movement 100.

The invention claimed is:

1. A timepiece assembly comprising:

a combined resonator with at least two degrees of freedom which includes a first linear or rotary oscillator with reduced amplitude oscillating substantially in a first direction relative to which oscillates a second linear or rotary oscillator with reduced amplitude oscillating substantially in a second direction substantially orthogonal to the first direction, the second oscillator comprising a second weight carrying a sliding-block; and a wheel set arranged for application of a torque to the resonator, the wheel set comprising a groove in which the sliding-block slides with minimal play, wherein the sliding-block is arranged at least either to follow curvature of the groove when present, or to rub with friction in the groove, or to repel inner lateral surfaces of the groove by magnetically or electrically charged surfaces comprised in the sliding-block.

2. The timepiece assembly according to claim 1, wherein the groove is substantially radial with respect to the pivot axis of the wheel set.

3. The timepiece assembly according to claim 1, wherein the groove includes at least one curved portion.

4. The timepiece assembly according to claim 3, wherein the groove comprises at least one concave area relative to a radial line derived from the pivot axis of the wheel set.

5. The timepiece assembly according to claim 3, wherein the groove comprises a first inner radial portion with respect to the axis of rotation of the wheel set, which is tangent to a second curved portion whose concavity is constant or decreases away from the axis of rotation.

6. The timepiece assembly according to claim 1, wherein the inner lateral surfaces are parallel.

7. The timepiece assembly according to claim 1, wherein the sliding-block comprises a friction pad sliding with friction in the groove, and a pin carried by the second weight pivots in the friction pad.

8. The timepiece assembly according to claim 7, wherein the friction pad has surfaces of contact with the inner lateral surfaces of the groove which are limited to two first semi-cylindrical bosses remote from one another cooperating with a first of the inner surfaces, and to two second semi-cylindrical bosses remote from one another cooperating with a second of the inner surfaces.

9. The timepiece assembly according to claim 7, wherein the friction pad comprises at least one resilient and/or hinged portion arranged to enable the pad to follow the curvature of the groove as the pad slides.

10. The timepiece assembly according to claim 7, wherein the friction pad carries an external cage of a ball bearing whose inner cage acts as a pivot for the pin.

11. The timepiece assembly according to claim 1, wherein the inner lateral surfaces of the groove are magnetically or electrically charged and are arranged to repel magnetically or electrically charged surfaces of the sliding-block.

12. The timepiece assembly according to claim 11, wherein the sliding-block comprises a ring slidably movable in the groove, and remote from the inner lateral surfaces of the groove under effect of magnetic and/or electrostatic repulsion fields, the ring being arranged to be mounted on a shaft portion of a pin carried by the second weight, or to form a the pin.

13. The timepiece assembly according to claim 1, wherein the first oscillator and/or the second oscillator is rotatable with a reduced angular amplitude of less than 12°.

14. A timepiece movement comprising a timepiece assembly according to claim 1.

15. A watch comprising a timepiece movement according to claim 14.

* * * * *